US005896609A

United States Patent [19]

Lin

[11] Patent Number: 5,896,609

[45] Date of Patent: Apr. 27, 1999

[54] SAFETY METHOD OF CONSTRUCTION A PRESTRESSED CABLE-STAY BRIDGE

[76] Inventor: Wei-Hwang Lin, Dept. of Military Engr. Chinese Military Academy 830 R.O.C., Feng-Shan, Taiwan

[21] Appl. No.: 08/975,780

[22] Filed: Nov. 21, 1997

[51] Int. Cl.[6] ..... E01D 11/00; E01D 23/00; E01D 21/00

[52] U.S. Cl. ..... 14/20; 14/18; 14/21; 14/23; 14/77.1

[58] Field of Search ..... 14/18, 19, 20, 14/21, 77.1, 23

[56] References Cited

U.S. PATENT DOCUMENTS

| | | | |
|---|---|---|---|
| 467,013 | 1/1892 | Miller | 14/21 |
| 3,677,189 | 7/1972 | Appelt | 104/24 |
| 4,352,220 | 10/1982 | Wittfoht | 14/1 |
| 4,907,312 | 3/1990 | Yang et al. | 14/21 |
| 5,072,474 | 12/1991 | Dilger et al. | 14/77.1 |

*Primary Examiner*—Thomas B. Will
*Assistant Examiner*—Gary Scott Hartmann

[57] ABSTRACT

A method of construction a prestressed cable-stay bridge is provided. The method includes the constructing at least a tower having a pier, a pair of masts and a girder between the masts for securing a deck, a main beam supported on the deck along a longitudinal direction of the bridge, a pair of sub-beams connect to two ends of the main beam and suspended from a plurality of temporal stay cables from the top of the masts, an upper portion and a plurality of segment secured on the top of the main beam and the sub-beam after the performance of on the spot prestressing procedure, a plurality of side reinforcements secured to the elongate gaps at two lateral side of the bridge, a plurality of permanent stay cables instead of the temporal stay cables for suspending the bridge from the inner side of the masts and a roadway paved on the top of the bridge. This disclosure further includes a plurality of safety plates provide along the lateral sides of the bridge to ensure a safe and convenient working condition to the working personnel.

14 Claims, 11 Drawing Sheets

SAFETY METHOD OF CONSTRUCTION A PRESTRESSED CABLE-STAY BRIDGE

BACKGROUND OF THE INVENTION

The present invention relates to construction of a cable-stay bridge and more particularly to a method of construction a prestressed cable-stay bridge with on the spot stressing of steel beams and concrete or asphalt slab which method tends to rapidly span the beams from one tower to another and to provide a safety working system for the spot stressing of the steel beams.

In the art, there are about two methods of constructing cable-stay bridges, One method is sequentially casting short segments in place. The other method is to lift short precast segments in place. Both methods are greatly consuming the time and labor and both methods are not safe for the working personnel because they are working at a high elevation without any guard device. Besides, each of the segments is suspended from the main tower by a skew cable. So that the top of the main tower should bear greatly the heavy load of the segments, thus the designer has to strengthen the structure of the tower and sacrifice its external nicety. Another method of constructing a cable-stayed bridge adapts a horizontally extending struss including an air filled tanks to aid in construction of the bridge over a body of water. When the struss is spanning from a first tower for example, to a second tower, it is supported by the tanks on the water and enables the struss to move further forward to be projected from the second tower to a third tower. A plurality of stay cables are then strung from a top of the second tower to a series of temporary connections to the struss before a deck portion is constructed on the struss. After the deck portion is finished and suspended from a set of permanent stay cables, the struss is then moved still further forward beyond the third tower for constructing additional deck portions. This type of construction a cable-stayed bridge is more safe than the above discussed methods. But it consumes more time and material.

The present invention is arisen to obviate and/or militate the disadvantages discussed the above for the prior art and provides a more safe and faster procedure to construct a cable-stayed bridge.

SUMMARY OF THE PRESENT INVENTION

The present invention comprises at least a tower of which includes a transverse girder at an appropriate middle portion for supporting a deck member which is in turn supporting a main steel beam of predetermined length along the longitudinal direction of the bridge and support at center part by the pier. The main steel beam has a pair of corbels laterally projected outward form two ends for securing a plurality of cylinder means which has a retaining ring at each end and are adapted to adjustably connect a plurality of skew temporal cables for temporarily suspending the first main steel beam from a top of the tower in proper tensions. A pair of sub-beams connect at two ends of the main steel beam and each has a single girder at free end for securing a pair of cylinder means in order to connect a pair of temporal cables for temporarily suspending the sub-beams from a top of the tower. Although, the sub-beams are remote from the deck member relative to the main steel beam, it is still safe and stable because they have the length and weight that is about one second of that of the main steel beam. When the beams on the tower are erected in place, another main beam and a pair of sub-beams are then erected on a second tower which is positioned at a predetermined distance from the first tower, so that the sub-beam from the first tower shall be coupled with the sub-beam from the second tower. A longitudinally arcuate upper portion is mounted onto each of the main beams and a plurality of laterally arcuate segments are mounted onto each of the sub-beams. Both the upper portion and the segments are prestressed on the spot by suitable pressing means before fastening them to the main beams and sub-beams. So that the bridge can either resist against the longitudinal tension force or the transverse tension force of the bridge. After the top portions and the segments are secured in place on the beams, a plurality of permanent stay cables are suspended from an inner sides of the top of the towers and connect spaced apart at two lateral side of the beams in order to substitute the temporal cables which are then removed together with the corbels and the cylinder means. Finally, a concrete or asphalt roadway is adapted to pave on the top of the bridge after a plurality of side reinforcements secured to the longitudinal gap in two lateral side of the beams.

Accordingly, the present invention has a main object to provide a safety method of construction a prestressed cable-stay bridge which method is more safe and faster in construction of a cable-stayed bridge.

Another object of the present invention is to provide a safety method of construction a prestressed cable-stay bridge which provides a steel beam of structure rigidity superior to that of caisson decks.

Still another object of the present invention is to provide a safety method of construction a prestressed cable-stay bridge in which the steel beams are prestressed on the spot of the bridge with suitable instrument so as to simplize the procedure rather than the casting the decks on the bridge.

Further object of the present invention in to provide a safety method of construction a prestressed cable-stay bridge in which a plurality of corbels are adapted to connect the stay cables and to dispose a plurality of safety plates which provide a wider and safe working space to the civil engineers and the labors.

Further object of the present invention is to provide a safety method of construction prestressed cable-stay bridge in which the most elements used are specified and can be releasable for repeated use.

The present invention will become more fully understood by reference to the following detailed description thereof when read in conjunction with the attached drawing.

DETAILED DESCRIPTION OF THE PREFERRED EMBODIMENT

Figure 1:
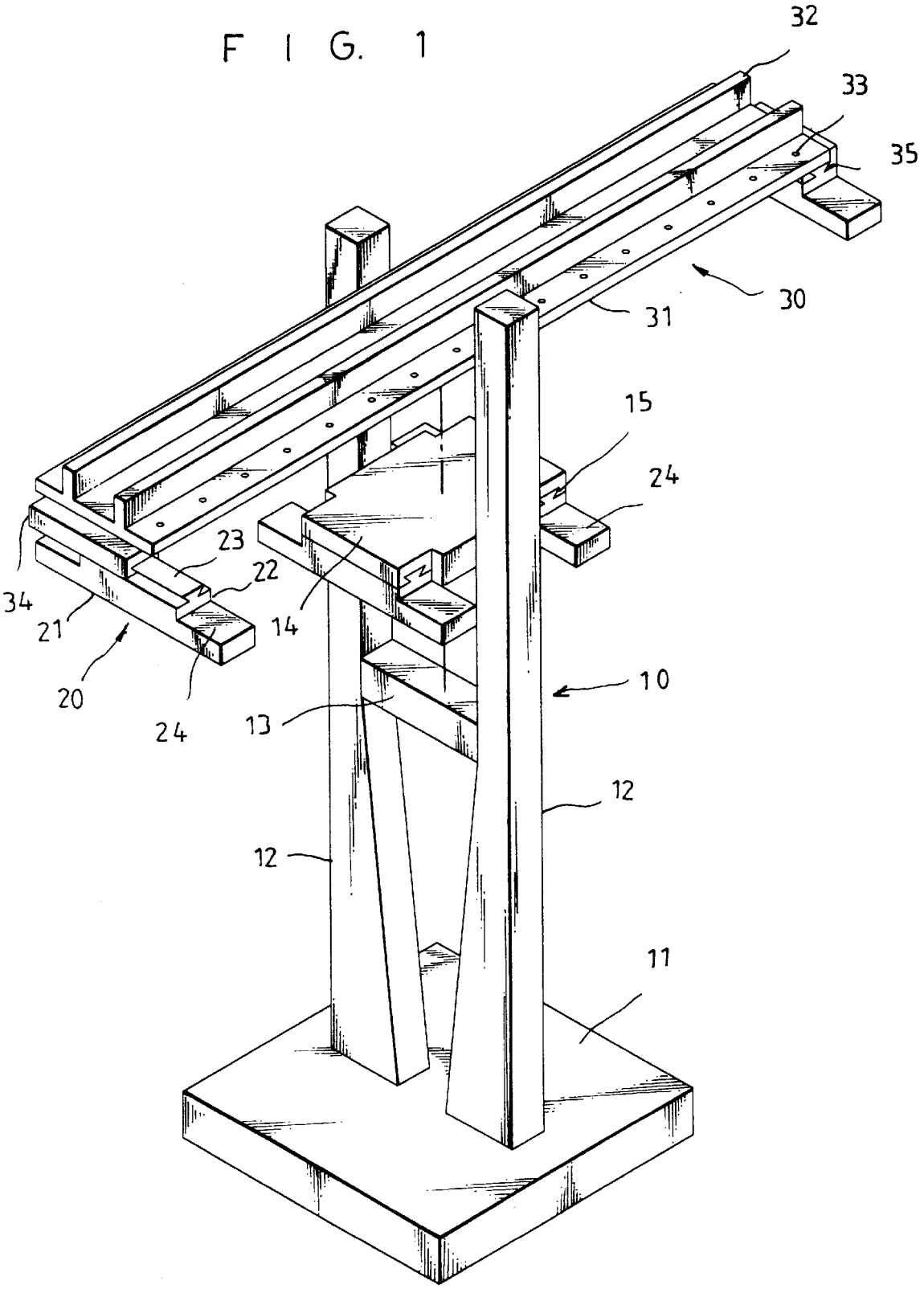
FIG. 1 is an exploded perspective view to show a preferred embodiment of the present invention.
Figures 2, 2A:
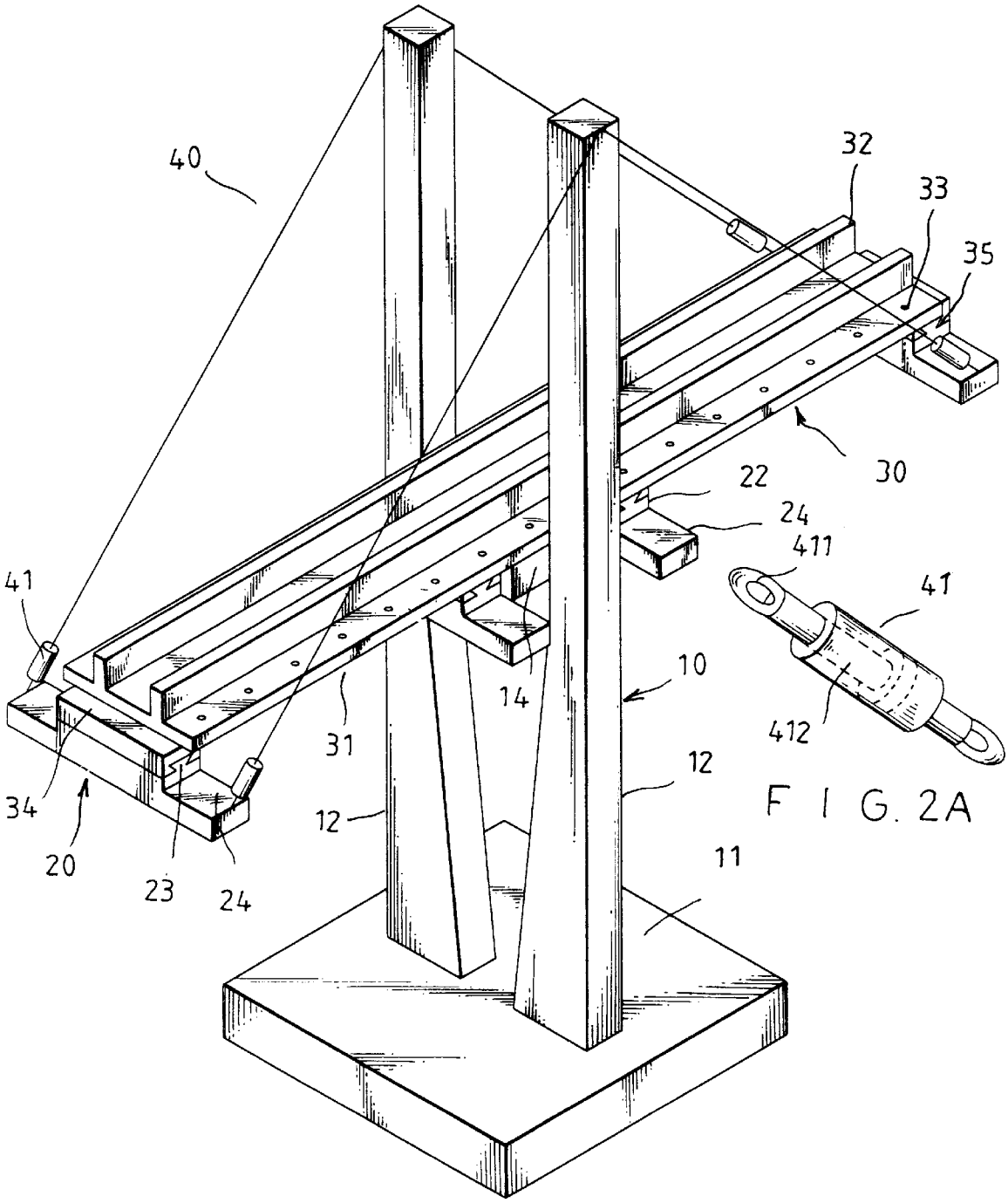
FIG. 2 and 2A are the perspective views to show that the first main steel beam is disposed on the deck member and suspended temporarily from the top of the first tower with temporal stay cables.
Figure 3:
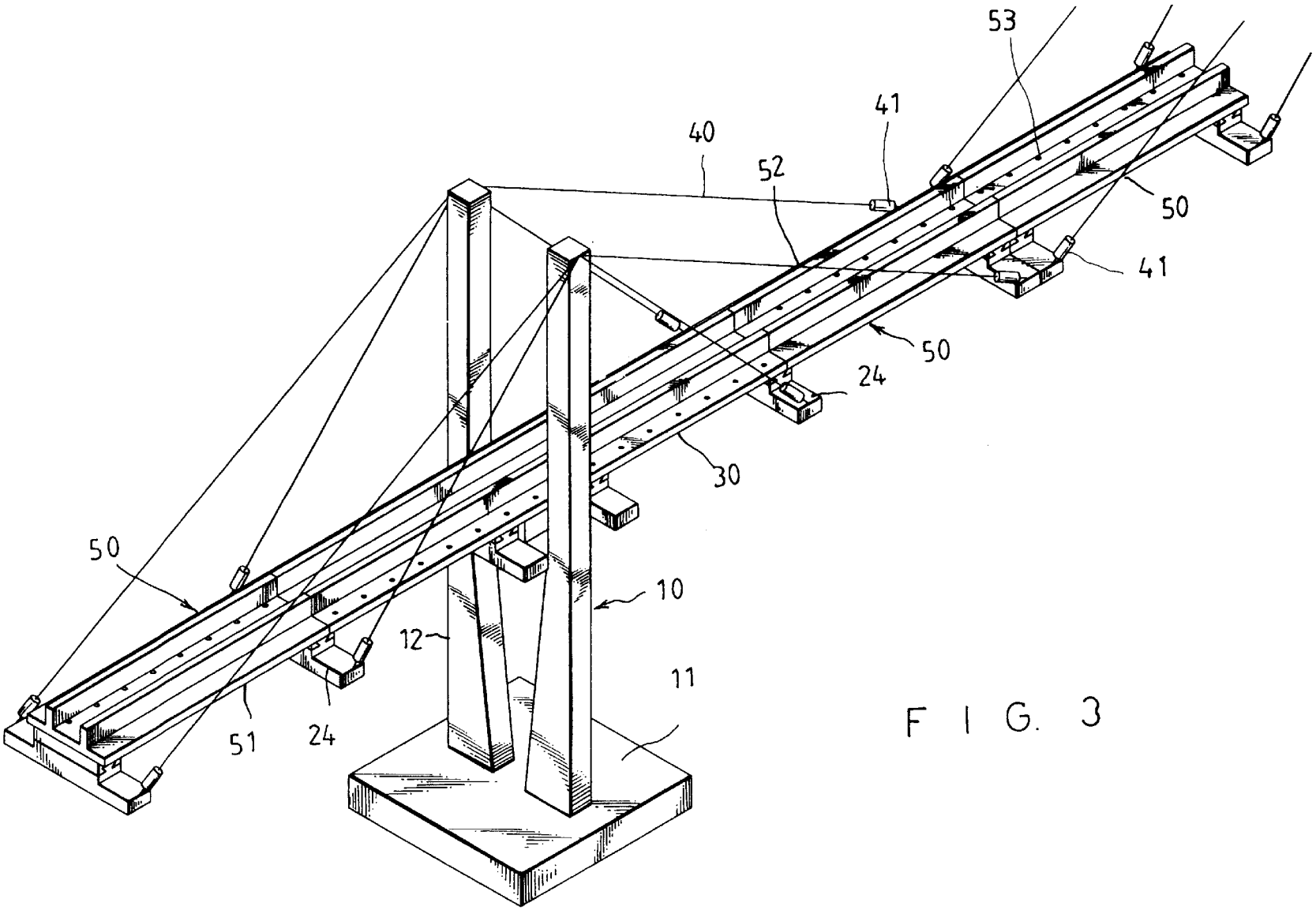
FIG. 3 is a perspective view to show a pair of sub-beams connecting two ends of the first main beam while another sub-beam from a second tower engages to the free end of one of the sub-beams.

Referring to FIGS. 1, 2 and 3 which display a cable-stay bridge of the present invention is under construction and which overspans across a body of water or a flat valley. The bridge comprises at least a tower 10. It is clearly understood that the invention is not linked to the number of towers because it can be substantially more or less depending upon the length of the bridge.

The tower is composed of a pier 11 founded on the ground for supporting a pair of masts 12 which parallel extend upward from the top of the pier 11 at a predetermined elevation, a girder means 13 transversely connected between the masts 12 and positioned at an appropriate middle portion of the masts 12 for supporting a deck member 14 which has a pair of dovetail grooves 15 transversely formed along an under side adjacent two ends thereof for respectively and releasably connecting a pair of corbel means 20 each of which consists an elongate rectangular body 21 longer than the width of the desk member 14, an upward projection on the central part having an elongate dovetail protrusion 23 centrally extended on a top along the longitudinal length of the upward projection 22 for slidably and releasbly engaging the corbel 20 into the dovetail groove 15 of the deck member 14 and a step extension 24 longitudinally extended outward at each end of the body 21.

A main steel beam 30 which on the center part longitudinally disposes to the top of the deck member 14 along the longitudinal axis of the bridge and is secured to the deck member 14 by suitable fastening means. The main steel bean 30 comprises a flat rectangular body 31 of predetermined length, a pair of webs 32 parallel extending on a central upper surface along the longitudinal length thereof, a plurality of spot face holes 33 extending spaced apart along the length and adjacent two lateral edges of the body 31 and a connection 34 integrated under each of the two ends to define a step therebetween. The connection includes a rectangular body of the length equal to the width of the main steel beam 30 and an elongate dovetail groove 35 longitudinally extending along the center of under side engageable with the dovetail elongate protrusion 23 of the corbel means 20. When the main steel beam 30 with a pair of corbel means 20 thereon is fastened to the deck member 14, a plurality of temporal stay cables 40 are adapted to suspend it from a top of the masts 12 (as shown in FIG. 2). The manner for connection the main steel beam 30 to the masts 12 is such that first secure a pair the temporal stay cables 40 onto an outer side on the top of each of the two masts 12 with suitable anchoring ties (not shown) and then connect the lower end of each of the stay cables 40 to the free end of the respective step extension 24 of the corbel means 20 at two ends of the beam 30 via a cylinder means 41 which has a retaining ring 411 at each of the two ends for respectively connecting the lower end of a stay cable and a connecting means from a free end of the corbel means 20 and a hydraulic jack 412 inside the cylinder 41 for adjusting the tension force of the cable 40 (as shown in FIGS. 2 and 2A). FIG. 3 shows a pair of sub-beams 50 are coupled to the free ends of the main beam 30 by means of welding or fastening. The sub-beams 50 is about half length and weight relative to the main beam 30 but its structure is mostly similar to the main beam 30 except that the spot face holes 53 extend spaced apart along the longitudinal length of the body inside each of the webs 52 and only one connection 34 integrates at a free end for releasably engaging with a corbel means 20. It is understood that the inner end of sub-beam 50 rests on the step between the connection 34 of the main beam 30 and connects end to end with the main beam 30. Another pairs of temporal cables 40 connect to each end of the corbel means 20 in the same manner as described the above and suspend the sub-beams from the outer sides on the top of the masts 12. This time, the entire load of the beams 30 and 50 is transmitted to the pier 11 by the masts 12 and the elements are temporarily immobilized and stable. Substantially, additional pairs of the sub-beams 50 can be added sequentially to the connected sub-beams 50 if necessary. However, this invention adapts one pair of the sub-beams 50 for one tower is for instance only.

If necessary, a second tower and third tower or a number of towers and its elements are constructed in the same manner as described the above for constructing the first tower. What is essential is that the free end of a sub-beam 50 from a second tower must be accurately joined to the free end of a corresponding sub-beams 50 from a first tower for example (as shown in FIG. 3), vice versa.

Figure 4:
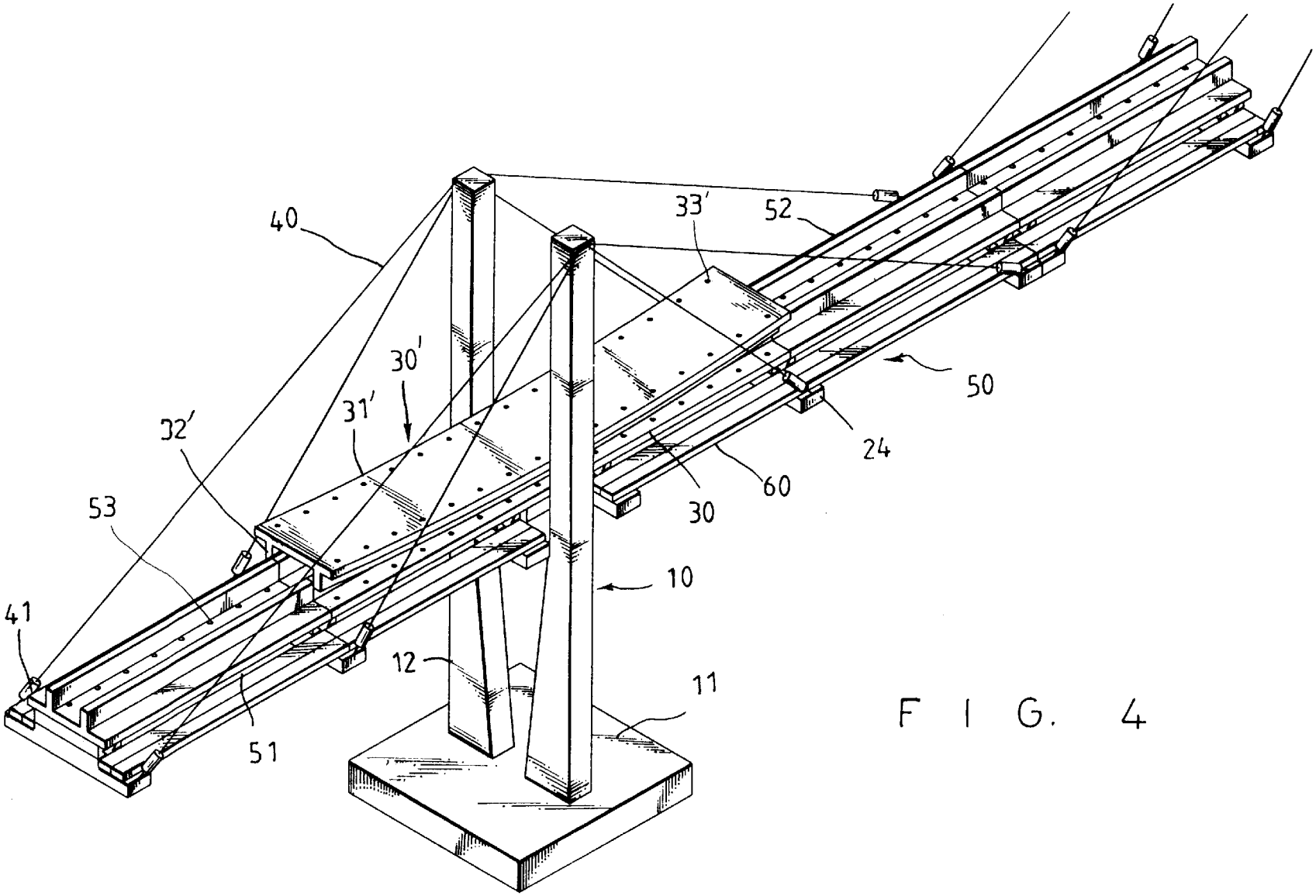
FIG. 4 is a perspective view to show that an upper portion of the main beam mounts on the main beam before the performance of the prestressing procedure.

FIG. 4 shows that a plurality of safety plates 60 parallel dispose to the step extension 24 of the corbels 20 on each of the lateral sides of the beams 30 and 50 along the length thereof. These safety plates are provided as a foot stand or platform to facilitate the working personnel to be worked safely at a high altitude and the safety plates of the inner alignment are removed when performs the prestressing procedure. An upper portion 30' of the main beam 30 mounts to the top of the main beam 30 before the procedure of prestressing. The upper portion 30' includes a longitudinally upward arcuate flat steel body 31' of the size equal to that of the main beam 30, a plurality of spot face holes 33' extending spaced apart adjacent the lateral edges along the length thereof and made in registry with the spot face holes 33 of the main beam 30 and a pair of webs 32' parallel extending on the under side along the length thereof. The webs 32' are spaced wider than that of the webs 32 so that the inner sides of the webs 32' are engageable with the outer sides of the webs 32 of the main beam 30.

Figures 10, 10A, 10B:
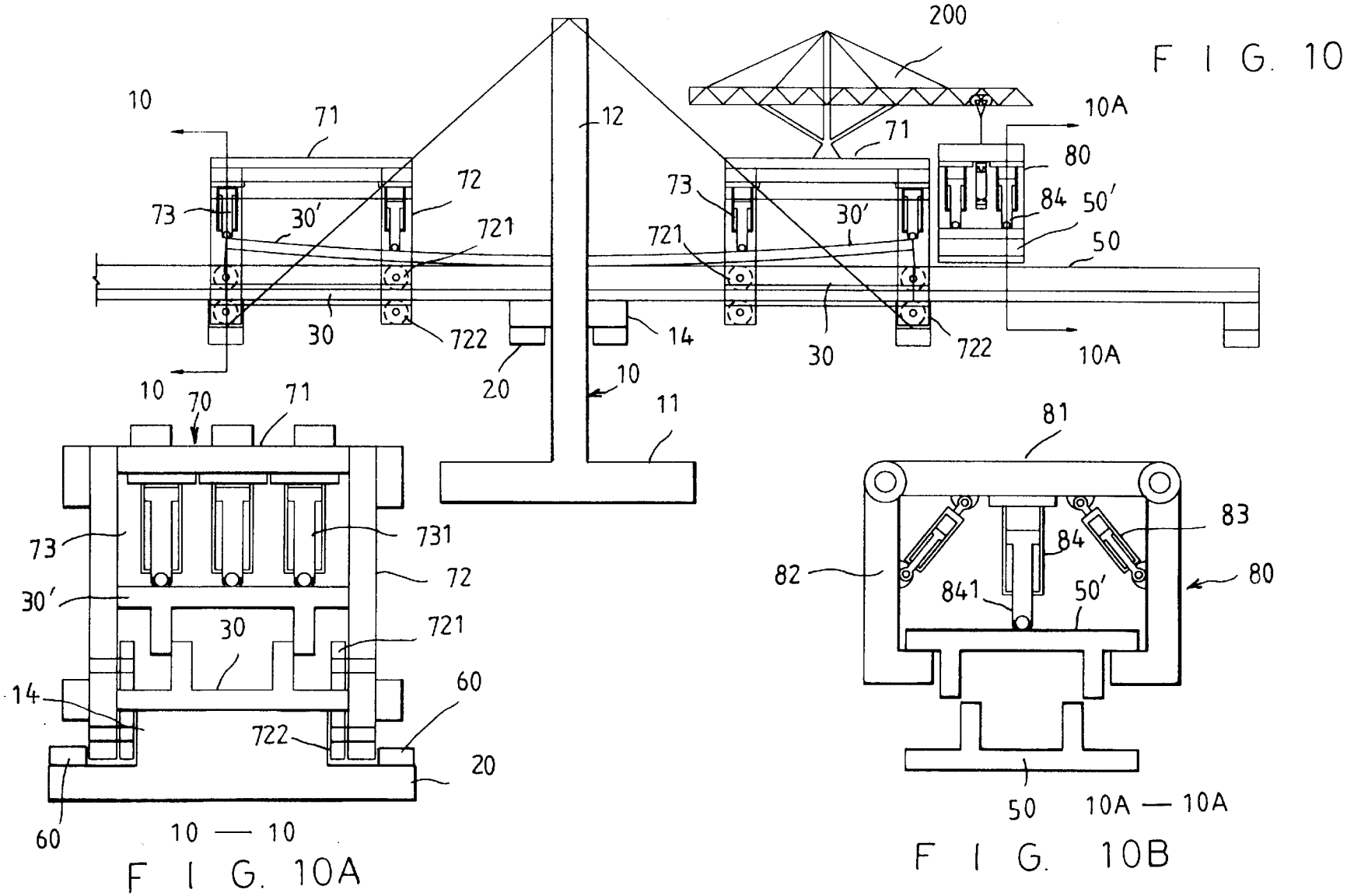
FIG. 10, 10A and 10B are the elevational views illustrating the prestressing procedures performed upon the upper portion and the segments.

FIG. 10 and 10A illustrate a cart 70 which is specified to perform on the spot prestressing procedure for the upper portion 30' of the main beam and includes a rectangular top portion 71 supported on four upright legs 72 at four corners defining a rectangular interior space of a width equal to that of the main beam 30. The top portion 71 carries a plurality of hydraulic presses 73 which are secured spaced apart to the under side and adjacent two longitudinal ends of the top portion 71 and each having a ball headed plunger 731 toward downward and engageable with the top of the upper portion 30' of the main beam 30. Each of the four legs 72 includes a pair of first and second wheels 721 and 722 rotatably and superposedly secured to an inner side abutting the lower end thereof so as to leave a gap therebetween equal to the thick of the main beam 30 so that the wheels 721 and 722 can rotate on the top and under side of the main beam 30 therebetween. Because the wheels 721 and 722 have a diameter equal to the height of the webs 32 and the corbel 14, thus the wheel 721 will not obstruct the engagement of the upper portion 30' with the main beam 30 and wheel 722 will not be disturbed by the corbel 14 too.

Figure 5:
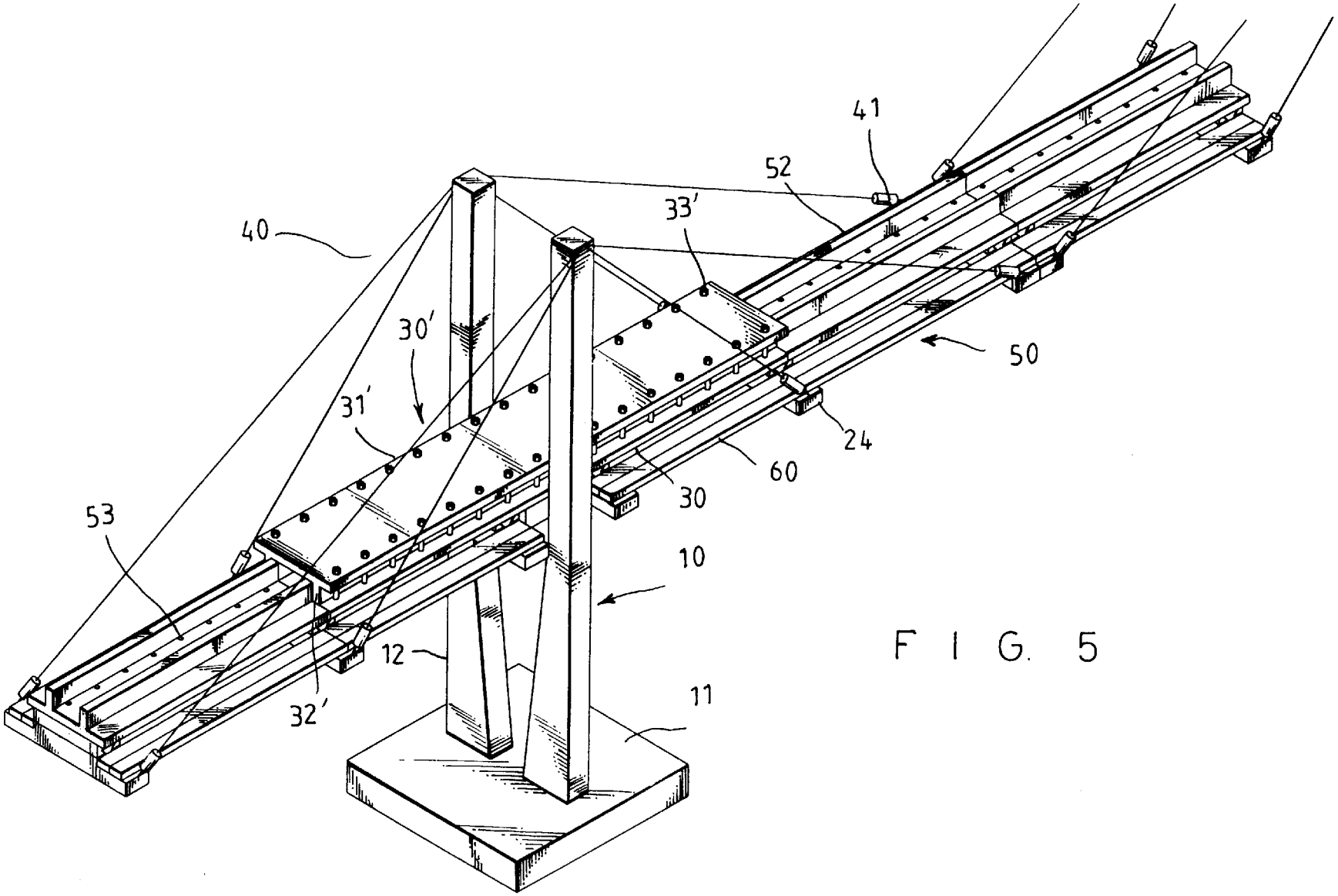
FIG. 5 is a perspective view indicating that the upper portion is fastened on the main beam after the performance of the prestressing procedure.
Figure 11:
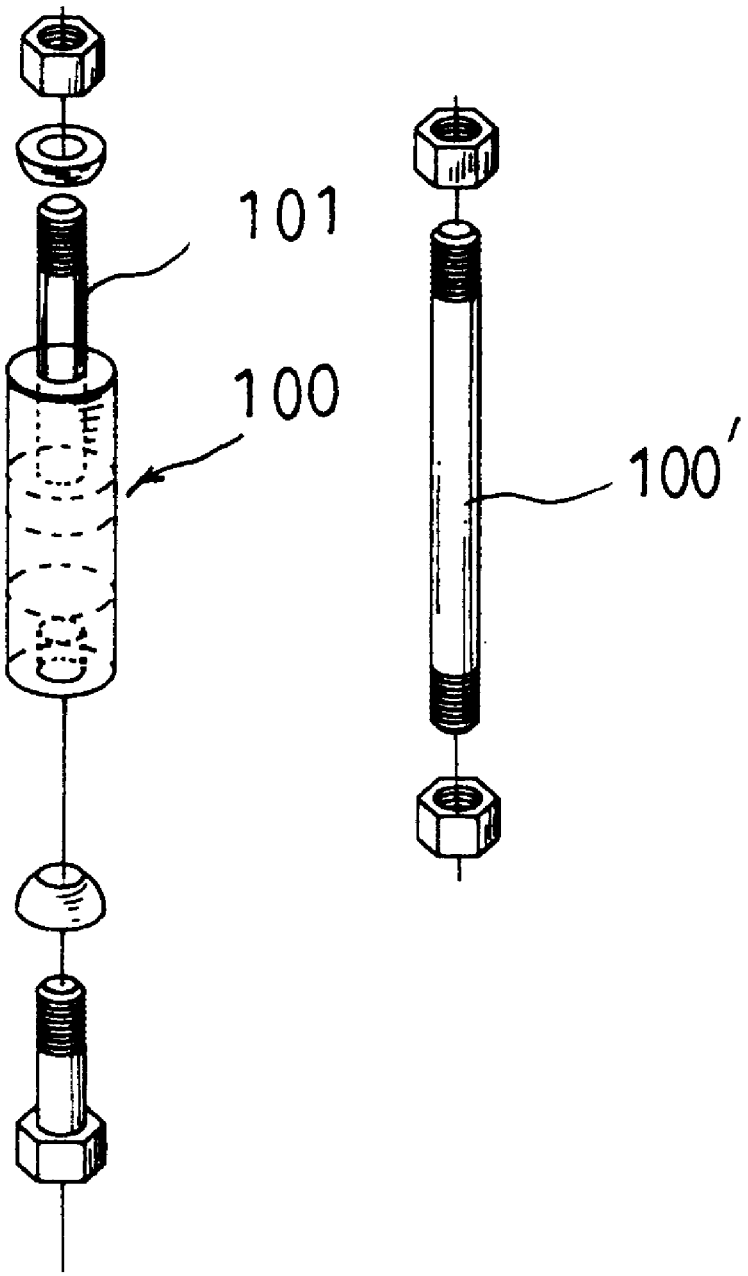
FIG. 11 is a perspective view to show a first and a second subsidiary tensioning means adapted to work out additional tensioning procedure when the upper portion is found unevenly prestressed.

Prior to move the cart 70 to the bridge, it is better to fasten the flat part of the upper portion 30' onto the main beam at their corresponding spot face holes 33 and 33'. This prevents the upper portion 30' from longitudinal movement when the prestressing procedure performs, and to remove the inner alignment of the safety plates 60 to leave a space for permitting the longitudinal movement of the legs 72 of the cart 70. FIG. 10 shows the cart 70 having been moved to the bridge and its hydraulic presses 73 engage with a first arcuate part of the upper portion 30'. This time the hydraulic presses 73 are operable by a hydraulic source attack to the top portion 71 and its ball headed plungers press downward on the upper portion 30' to force the first arcuate part thereof becoming flat and then fix the upper portion 30' with a plurality of a first or second fastening means 100 and 100' (as shown in FIG. 11) through their corresponding spot face holes 33 and 33'. When on the spot prestressing procedure is finished, moved the cart 70 to a second arcuate part and do the same as described the above. So that a sufficient prestress is reversed within the main beam 30 to resist against the longitudinal tension force of the bridge (as shown in FIG. 5).

Figure 6:
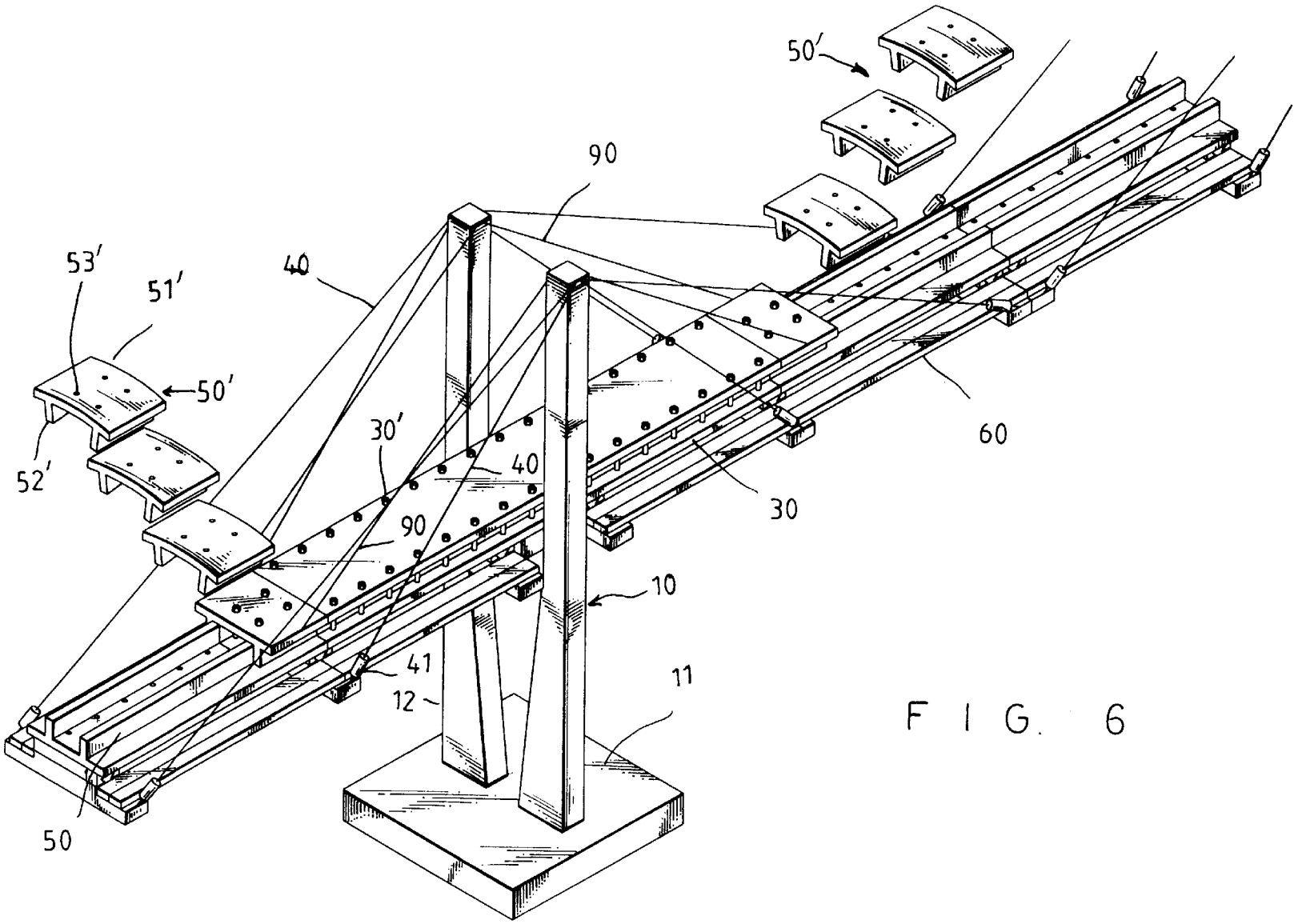
FIG. 6 is a perspective view to show a plurality of segments mounting onto the sub-beams before the performance of the prestressing procedure.

FIG. 6 shows that a plurality of steel segments 50' are sequentially securing to the top of the sub-beams 50. The segments 50' each includes a transversely downward arcuate flat body 51' of the width equal to that of the sub-beam 50, a pair webs 52' parallel extending along the longitudinal length in alignment with the webs 32' of the upper portion 30' of the main beam 30 so that their inner sides are engageable with the outer sides of the webs 52, and a plurality of spot face holes 53' extending spaced apart adjacent inside of each of the webs 52' along the length thereof and made in registry with the corresponding spot face holes 53.

Referring to FIG. 10B and again FIG. 10, a pressing machine 80 is adaptable to perform on the spot prestressing procedure of the segments 50'. The machine 80 comprises a rectangular upper part 81, a pair of lateral parts 82 of L-shaped section hinged on the lateral edges of the upper part 81 in symmetrical manner and operable by a pair of skew cylinders 83 which connect to a center of the inner surface of the upper part 81 and lateral parts 82, and a plurality of hydraulic presses 84 secured spaced apart to the center of the under side of the upper part 81 along the length thereof each including a ball headed plunger 841 toward downward and engageable with the central top of the segments this pressing machine 80 is assisted in of a crane 200 which lifts the machine 80 on the top of a working segment 50'. Then the lateral parts 82 is operated by the skew cylinders 83 to rotate outward and then inward to have their transverse portions of the L-shaped engaged with the under side of the lateral portions of the segment 50' which is then held by the pressing machine 80 and lifted up and is pressed on the top center by the hydraulic presses 84 until that the arcuate body thereof became flat. Then move down the machine 80 together with pressed segment 50' and engage the segments 50' in place with the sub-beam 50 so as to be secured by the second fastening means 100' via their corresponding spot face holes 53 and 53'. After a segment 50' is fixed, the crane 200 lifts the pressing machine 80 forward to work for next segment 50' on one by one basis. It is understood that these segments after the above discussed procedure contain lateral prestress for resisting against the transverse tension force of the bridge.

Figure 7:
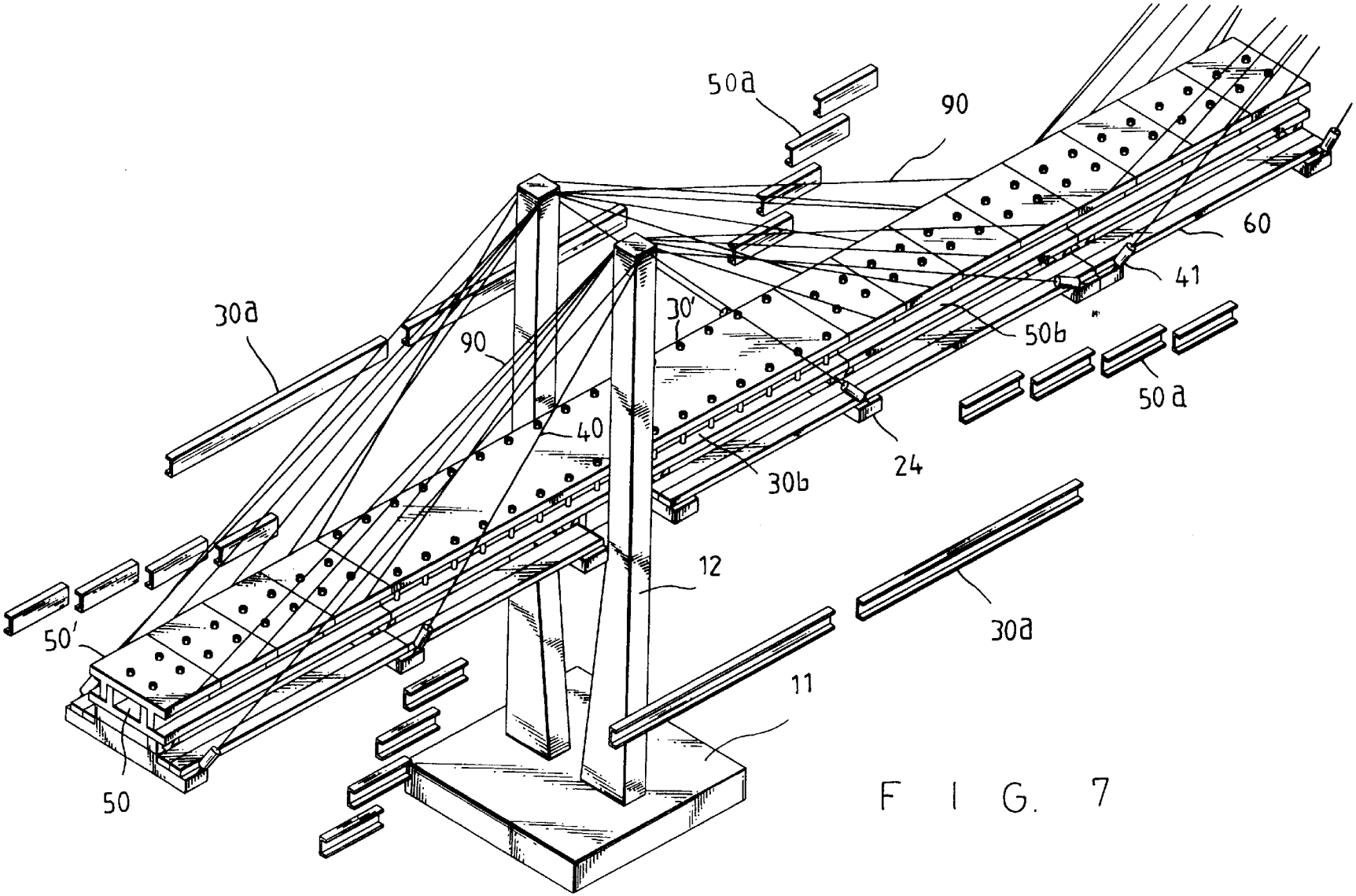
FIG. 7 is a perspective view to show that the segments are fastened on the sub-beams after the performance of the prestressing procedure and a plurality of side reinforcement are about to secure to the side gaps between the main beam and the upper portion or the sub-beams and the segments.
Figure 8:
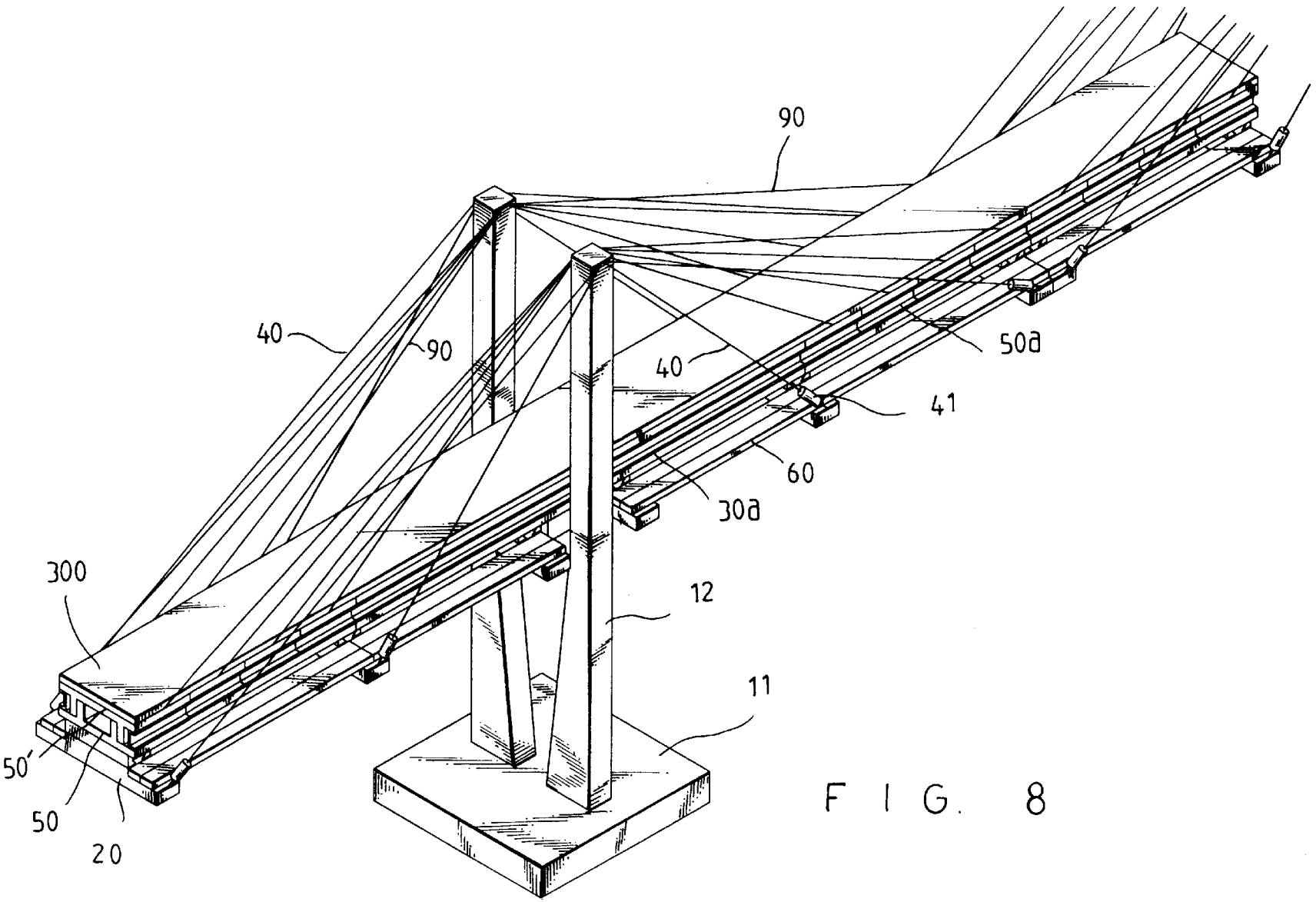
FIG. 8 is a perspective view to show that a concrete or asphalt roadway is paved.

FIGS. 7 and 8 shows a plurality of first and second side reinforcements 30*a* and 50*a* mounting respectively into the elongate gaps 30*b* and 50*b* between the upper portion 30' and the mean beam 30 and/or the segments 50' and the sub-beams 50 and securing by rivets. The side reinforcement 30*a* and 50*a* each has a U-shaped section with the first side reinforcement 30*a* longer than the second side reinforcement 50*a*. This arrangement facilitates that the collective length of the reinforcements 30*a* and 50*a* would coincide with the entire length of the bridge. Upon the adoption of these reinforcements 30*a* and 50*a*, The bridge will be more strong to resist against the tension force from transverse orientation.

A plurality of the permanent stay cables 90 are anchored to the inner top of the masts 12 for substituting those temporal stay cable 40. The permanent stay cables 90 have their upper ends suspended from a suitable anchoring ties (not shown) on the inner top of each of the masts 12 and their lower ends secured respectively to the central lateral edges of each of the segments 50' in predetermined tension in order that the bridge will be stable and rigid after the removal of the temporal stay cables 40.

Figure 9:
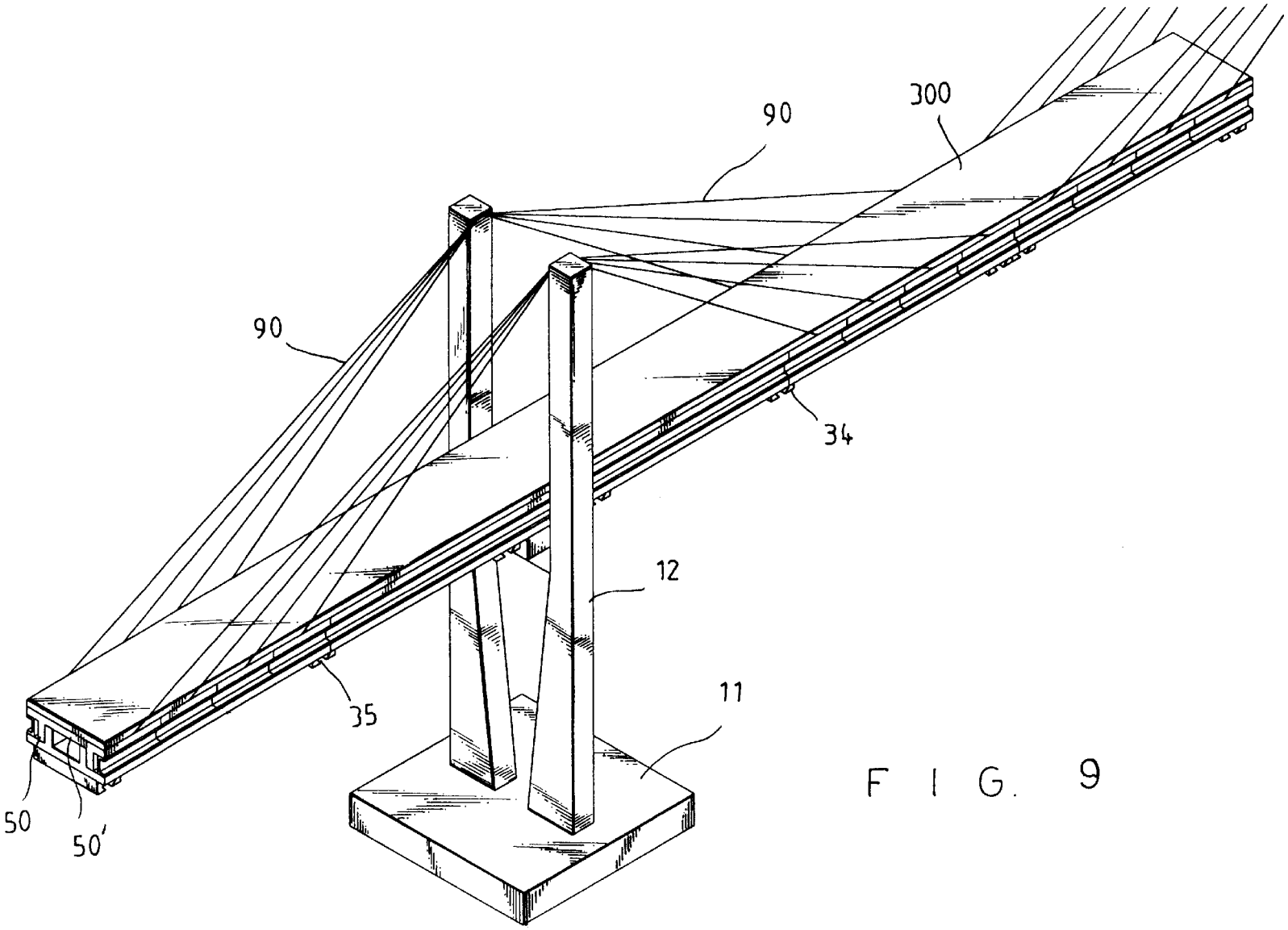
FIG. 9 is a perspective view to show that a concrete or asphalt roadway is paved, and the temporal stay cables and safety plates are removed.

Since the permanent stay cables 90 are anchored. The final step is to pave the roadway 300 on the top of the bridge (as shown in FIG. 8). The material for paving the roadway 300 may be the concrete or asphalt depending on the local climate and traffic condition. FIG. 9 shows a completion of the cable-stay bridge of the present invention in which both the corbels 20, the temporal stay cables 40 and the safety plates 60 are removed for repeated use and the dovetail groove 15 and 35 under each of the desk member 14 and of the connections 34 are reserved to facilitate the later repairment of the bridge.

FIG. 11 shows the first and second fastening means 100 and 100' as discussed the above. The first fastening means 100 is a cylinder including a plunger 101 which is capable of a subsidiary tension system, to provide additional tension procedure if anywhere in the upper portion 30' is pressed insufficiently. Whereas, the second fastening means 100' is a threaded rod strong enough to ensure a stiff securement between the upper portion 30' and the main beam or between the segment 50 and the sub-beams 50.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A method of construction a prestressed cable-stay bridge comprising:

At least a tower including a pier founded on a ground, a pair of masts parallel extending upward from a top of the pier at predetermined elevation having on a middle part thereof integrated with a transverse girder means which supports on a deck member including a pair of corbel means transversely and releasably engaging, into a pair of dovetail grooves in an under side adjacent two longitudinal ends thereof, a main beam secured on its central part to the deck member along the longitudinal axis of said bridge and suspended at four corners by a plurality of temporal stay cables from an anchoring means on an outer side adjacent the top of the masts, a pair of sub-beam longitudinally coupled with two longitudinal ends of the main beam respectively and suspended at lateral side of their free ends by two pairs of additional temporal stay cables from the top of the masts with their free ends engaged with a corresponding sub-beam from additional towers, an upper portion and a plurality of segments mounting respectively to the top of the main beam and the sub-beams which are respectively conducted of on the spot prestressing procedure by suitable means prior to secured to the beams by suitable fastening means, a plurality of first and second side reinforcements securing to a pair of longitudinal gaps along each of the lateral sides of said bridge between the upper portion and the main beam and/or the segments and the sub-beams, two sheets of permanent stay cables instead of the temporal stay cables suspending the beams form the top of the masts wherein the upper end of each sheet of the permanent stay cables securing to an anchoring means on an inner side adjacent the top of the masts and their lower ends securing spaced apart to respective lateral edges of the beams and a roadway is paved on the upper surface of said bridge.

2. A method as recited in claim 1 wherein said corbel means which are respectively and releasable engaged into an under side adjacent two ends of the girder means and the main beam and one side of the sub-beams and each consisting of an elongate rectangular body longer than the width of the girder means and the beams, an upward projection on a central part including an elongate dovetail protrusion centrally extending in a top along the length thereof and a step extension longitudinal extending outward from each of two each thereof.

3. A method as recited in claim 1 wherein said main beam is made from steel and including a flat rectangular body of predetermined length, a pair of webs parallel extending on center upper surface along the longitudinal length thereof, a plurality of spot face holes extending spaced apart along the length and adjacent each of lateral edges thereof and a connection means which is integrated under of each end longitudinal of the main beam defining a step therebetween and a dovetail groove engageable with the dovetail protrusion of the corbel means extending centrally in an under side along the longitudinal length thereof.

4. A method as recited in claim 1 wherein said upper portion is made from steel and includes a longitudinal upward arcuate body of a size equal to that of the main beam, a pair of webs parallel extending on an under side along the length thereof and having a space wider than that of the webs of the main beam so as to be able to engage on their inner surfaces with the outer surfaces of the webs of the main beam and a plurality of spot face holes extending spaced apart adjacent each of the lateral edges along the length thereof and made in registry with the spot face holes of the main beam.

5. A method as recited in claim 1 wherein said sub-beam is made from steel having a width equal to that of the main beam and a length about the half length of the main beam and includes a pair of webs parallel extending on an upper surface along the longitudinal length thereof and made in alignment with the webs of the main beam, and a plurality of spot face holes extending spaced apart adjacent the inner side of each of the webs along the length thereof.

6. A method as recited in claim 1 wherein said segment includes a transversely downward arcuate flat body of a width equal to that of the sub-beam, a pair of webs parallel extending along the longitudinal length and made in alignment with the webs of the upper portion and a plurality of spot face holes extending spaced apart adjacent the inner side of each of the webs along the length thereof and made in registry with the corresponding spot face holes of the sub-beam.

7. A method as recited in claim 1 wherein said suitable means for conducting on the spot prestressing procedure to the upper portion is a cart which includes a rectangular top portion supported on four upright legs at four corners thereof defining a rectangular interior space of a width equal to that of the main beam, each of the legs including a pair of wheels rotatably and superposedly secured to an inner side above the lower end thereof so as to define a gap therebetween for receiving the lateral edges of the main beam and a plurality of hydraulic presses secured spaced apart to an under side of the top portion adjacent each of the longitudinal ends thereof, said presses each having a ball headed plunger toward downward and engageable with the top of the upper portion for pressing the longitudinally upward arcutate part of the upper portion to become flat.

8. A method as recited in claim 1 wherein said suitable mains for conducting on the spot prestressing procedure to the segments is a pressing machine includes a rectangular upper part, a pair of lateral parts of L-shaped section hinged on the lateral edges of the upper part in symmetrical manner and operable by a pair of skew cylinders which secure to a center of the inner surface of the upper part and lateral parts and a plurality of hydraulic presses centrally secured spaced apart to the under side of the upper part along the length thereof each having a ball headed plunger extending downward and engageable to the central top of the segment for pressing the laterally downward arcuate part of the segment to become flat.

9. A method as recited in claim 1 wherein said fastening means for fastening the upper portion on the main beam and the segment on sub-beam are a cylinder including a plunger capable of conducting subsidiary tension procedure and a threaded rod.

10. A method as recited in claim 1 wherein said side reinforcement includes a first and a second side reinforcements of U-shape section with the length of the first reinforcement longer than that of the second reinforcement.

11. A method as recited in claim 1 wherein said permanent stay cables have their lower ends connect to the center of each of the lateral sides of each segment respectively.

12. A method as recited in claim 1 further includes a plurality of safety plates releasably disposed to the step extension at each end of the corbel means abutting the lateral sides of the beams along the length thereof.

13. A method as recited in claim 1 further includes a plurality of cylinder for adjustably connecting the lower end of the temporal stay cables with the stop end of each of the corbel means, said cylinder having a retaining ring at each end.

14. A method as recited in claim 1 said roadway may made of concrete or asphalt depending upon the local climate and the traffic condition.

* * * * *